United States Patent [19]

Rollot et al.

[11] Patent Number: 4,669,708

[45] Date of Patent: Jun. 2, 1987

[54] COOLING PLATES FOR BLAST-FURNACES

[75] Inventors: Pierre Rollot, Prouvy; Gerard Pierrat, Sedan; Claude Le Scour, Bray Dunes, all of France

[73] Assignee: Union Siderurgique du Nord et de l'Est de la France, Puteaux, France

[21] Appl. No.: 843,934

[22] Filed: Mar. 24, 1986

Related U.S. Application Data

[63] Continuation of Ser. No. 653,130, Sep. 21, 1984, abandoned.

[30] Foreign Application Priority Data

Sep. 21, 1983 [FR] France ..... 83 15014

[51] Int. Cl.[4] ..... C21B 7/10

[52] U.S. Cl. ..... 266/193; 122/6 B

[58] Field of Search ..... 266/193, 194, 190; 373/165; 122/6 A, 6 L, 6 B

[56] References Cited

U.S. PATENT DOCUMENTS

| | | | |
|---|---|---|---|
| 3,849,587 | 11/1974 | Hatch et al. | 373/165 |
| 3,953,008 | 4/1976 | Bashinsky et al. | 266/193 |
| 4,437,651 | 3/1984 | Cordier et al. | 266/193 |

FOREIGN PATENT DOCUMENTS

| | | | |
|---|---|---|---|
| 2738879 | 5/1978 | Fed. Rep. of Germany | 266/193 |
| 2182562 | 12/1973 | France . | |
| 2230730 | 12/1974 | France . | |
| 2389088 | 11/1978 | France . | |
| 0052039 | 5/1982 | France . | |
| 1571789 | 7/1980 | United Kingdom . | |

*Primary Examiner*—L. Dewayne Rutledge
*Assistant Examiner*—S. Kastler
*Attorney, Agent, or Firm*—Cushman, Darby & Cushman

[57] ABSTRACT

The cooling plate 1 comprises a cast iron element having substantially the shape of a parallelepiped, embedded longitudinally extending tubes 3; 103 disposed vertically and parallel to one another and extending out of said element on a first side 2*b;* 102*b* of said element, and a protective sleeve 4*a,* 4*b* surrounding portions of said tubes extending out of said element. A second side of said element opposed to said first side has a waffle shape formed by rows of bosses 8; 108 evenly spaced apart transversely of said element. The bosses of a row define projecting surfaces 9; 109 comprising substantially aligned portions of a cylinder, said cylinders having axes substantially coinciding with axes of said tubes 3.

6 Claims, 6 Drawing Figures

COOLING PLATES FOR BLAST-FURNACES

This is a continuation of application Ser. No. 653,130, filed Sept. 21, 1984, which was abandoned upon the filing hereof.

The present invention relates to cooling plates for blast-furnaces.

These cooling plates are elements disposed against the inner side of the armour and perform a double function of cooling the refractory lining and providing a screen for the passage of the heat flow toward the armour.

The use of such cooling plates disposed between the inner wall of the armour and the refractory lining has been rendered necessary owing to variations in the heat flows involved in modern techniques for working blast-furnaces; these variations may be localized, rapid and aleatory with respect to time.

The cooling plates are formed by cast iron elements through which extends within their thickness a network of tubes in which flows a cooling fluid, usually water. These cooling tubes extend out of one side of the cooling plates and extend through the armour on the outside of which they are connected to cooling tubes of an upper or lower adjacent plate. The tubes connected in this way determine circulation lines of the fluid rising in a substantially vertical plane along the wall of the blast-furnace these lines being connected to an exterior fluid circulating and cooling circuit.

The cooling plate must be so designed as to:

resist thermo-mechanical deformations resulting from high heat flows;

ensure a good thermal exchange with the refractory lining, which implies disposing on the hot side shapes which facilitate an effective hooking of the refractory.

Now, cooling plates known up to the present time did not give full satisfaction as concerns these conditions and had defects which resulted, owing to repeated thermal stresses, in cracks within their thickness and, consequently, in a risk of leakages of the heat-carrying or exchanging fluids inside the blast-furnace, and in a mechanical stress in the cooling tubes in the region where they extend out of the cooling plates and extend through the armour.

In order to overcome these difficulties, there has been described in the patent No. FR 2 493 871, the application of which forms the priority basis for U.S. Pat. No. 4,437,651, a cooling plate formed by a cast iron element having a substantially parallelpiped shape in which are embedded longitudinal tubes disposed parallel to one another, these tubes leading out of the plate on the same main side thereof, respectively at the upper and lower parts of the cooling plate, in a protective sleeve, one of the original features of which resides in the waffle shape of the side opposed to that from which the cooling tubes extend.

The present invention concerns an improvement in this type of plate for the purpose of increasing the reliability of operation, in particular owing to an improved equilibrium of the thermo-mechanical stresses produced within the cooling plate.

The present invention therefore provides a cooling plate formed by a cast iron element which has substantially the shape of a parallelpiped and in which are embedded longitudinal tubes which are disposed vertically and parallel to one another, said tubes extending out of the same side of the plate, the side of the plate opposed to that from which the cooling tubes extend having a waffle shape, wherein the waffling is formed by rows of bosses which are transversely evenly spaced apart, the bosses of one row defining projecting surfaces including portions of a cylinder whose axes are in longitudinal alignment and substantially coincide with the axes of the longitudinal tubes.

According to a modification, the inlets and/or the outlets of some longitudinal tubes are transversely offset relative to the longitudinal parts of said tubes, and are preferably located in the vicinity of the corners of the plate.

The invention will be described hereinafter in more detail with reference to the accompanying drawings which are given merely by way of example.

Figure 1:
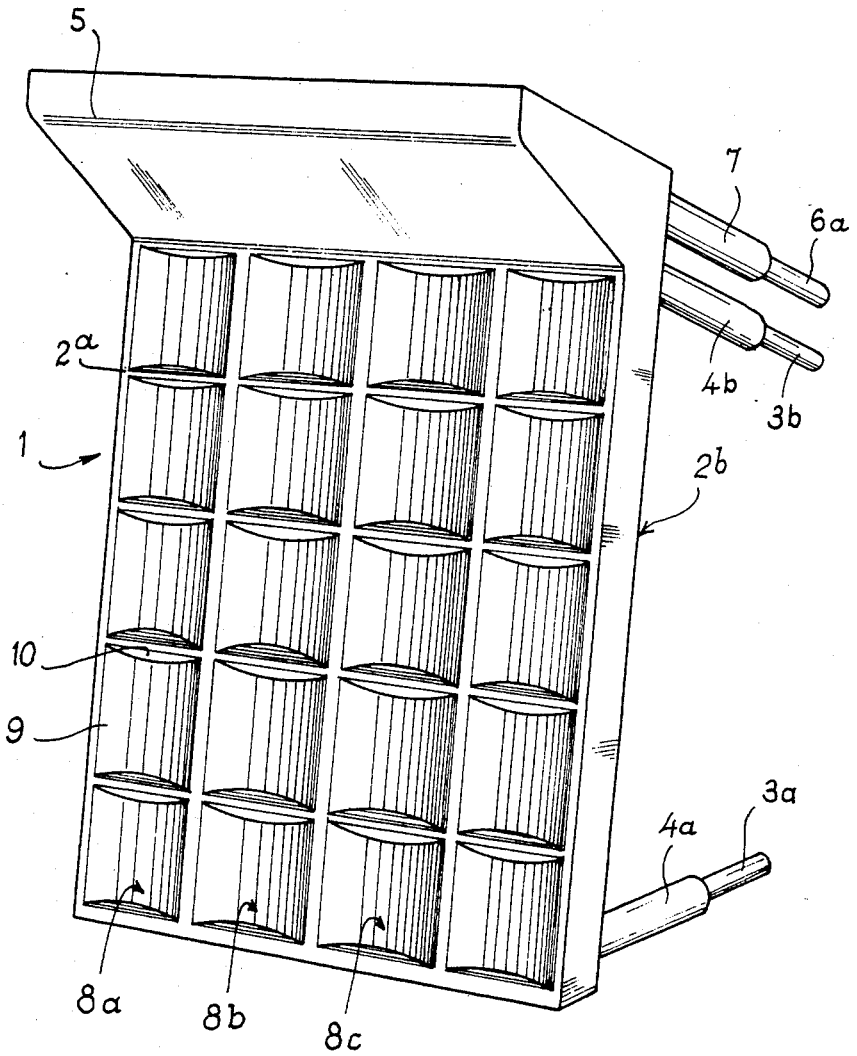
FIG. 1 is a perspective view of a cooling plate according to the invention corresponding to a particular application concerning the last row of a "stave-cooler" system.

In FIG. 1, the cooling plate 1 is viewed from its side 2*a* which faces the interior of the blast-furnace and receives the refractory lining. Extending out of its opposite side 2*b* are the inlets 3*a* and outlets 3*b* of longitudinal cooling tubes 3 which are embedded in the body of the plate 1. The ends 3*a* and 3*b* of each cooling tube extend out of the plate 1 at the upper and lower parts respectively through sleeves 4*a* and 4*b* which are embedded within the thickness of the iron of the cooling plate and also serve to fix the latter to the armour (not shown) of the blast-furnace.

The cooling plate 1 comprises, in its upper part, a lip 5 cooled by a transverse tube 6 which is disposed horizontally and which has an inlet end 6*a* in the vicinity of the outlet 3*b* of the tube 3, this outlet end being also surrounded by a sleeve 7 having one end embedded in the cooling plate. The cooling plate 1 has on its side 2*a* a group of bosses 8*a*, 8*b*, 8*c*, etc. which are identical and spaced apart transversely and aligned longitudinally so as to constitute rows.

Figure 2:
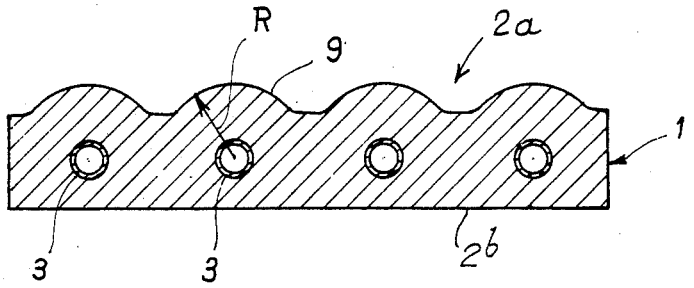
FIG. 2 is a cross-sectional view of the plate shown in FIG. 1, approximately in the middle of this plate.

These distinct bosses have external surfaces 9 which project from the side 2*a* of the plate in the shape of portions of a cylinder. The transversely extending end surfaces 10 of these bosses are beveled. The axes of the portions of a cylinder constituting the surfaces 9 are longitudinally aligned, while the confronting transversely extending surfaces 10 of two adjacent bosses form a transverse V-section groove. As can be seen in FIG. 2, the cooling tubes 3 are embedded in the body of cast iron plate 1 and their axes coincide with the axes of the cylindrical surfaces 9 forming the bosses, so that they are placed in the regions where the thickness of the cross-section of the plate is maximum.

Figure 3:
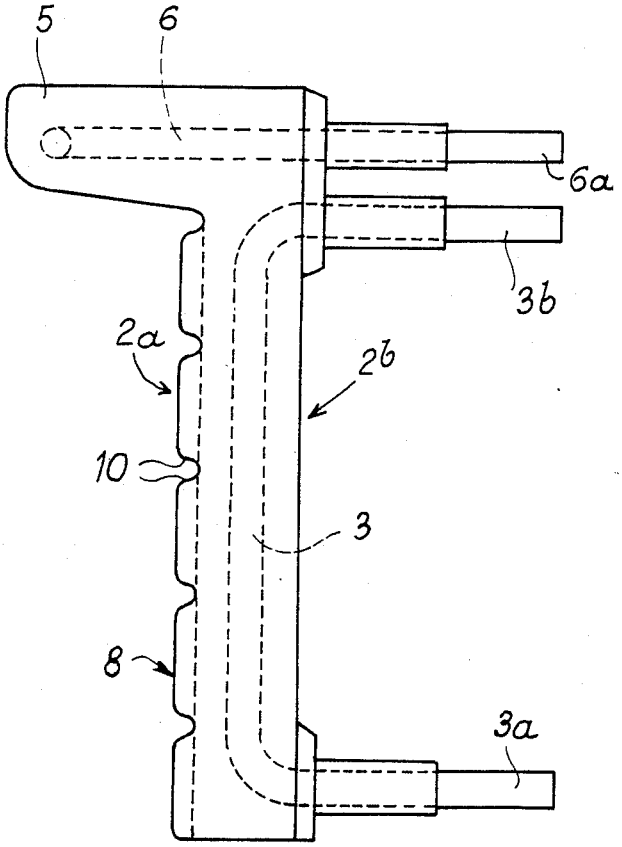
FIG. 3 is a side elevational view of the plate shown in FIG. 1.
Figure 4:
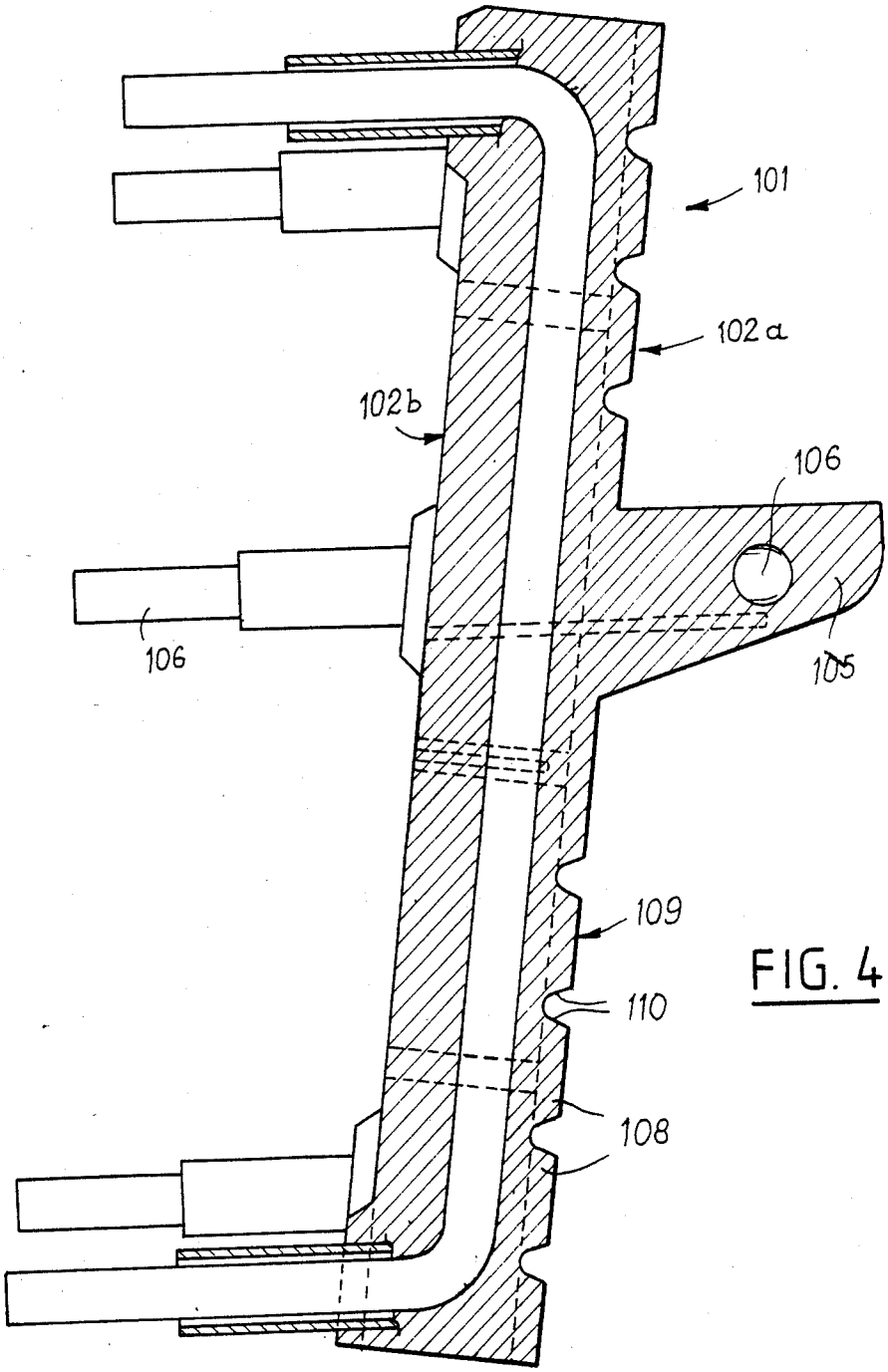
FIG. 4 is a sectional view of a plate according to a modification.
Figure 5:
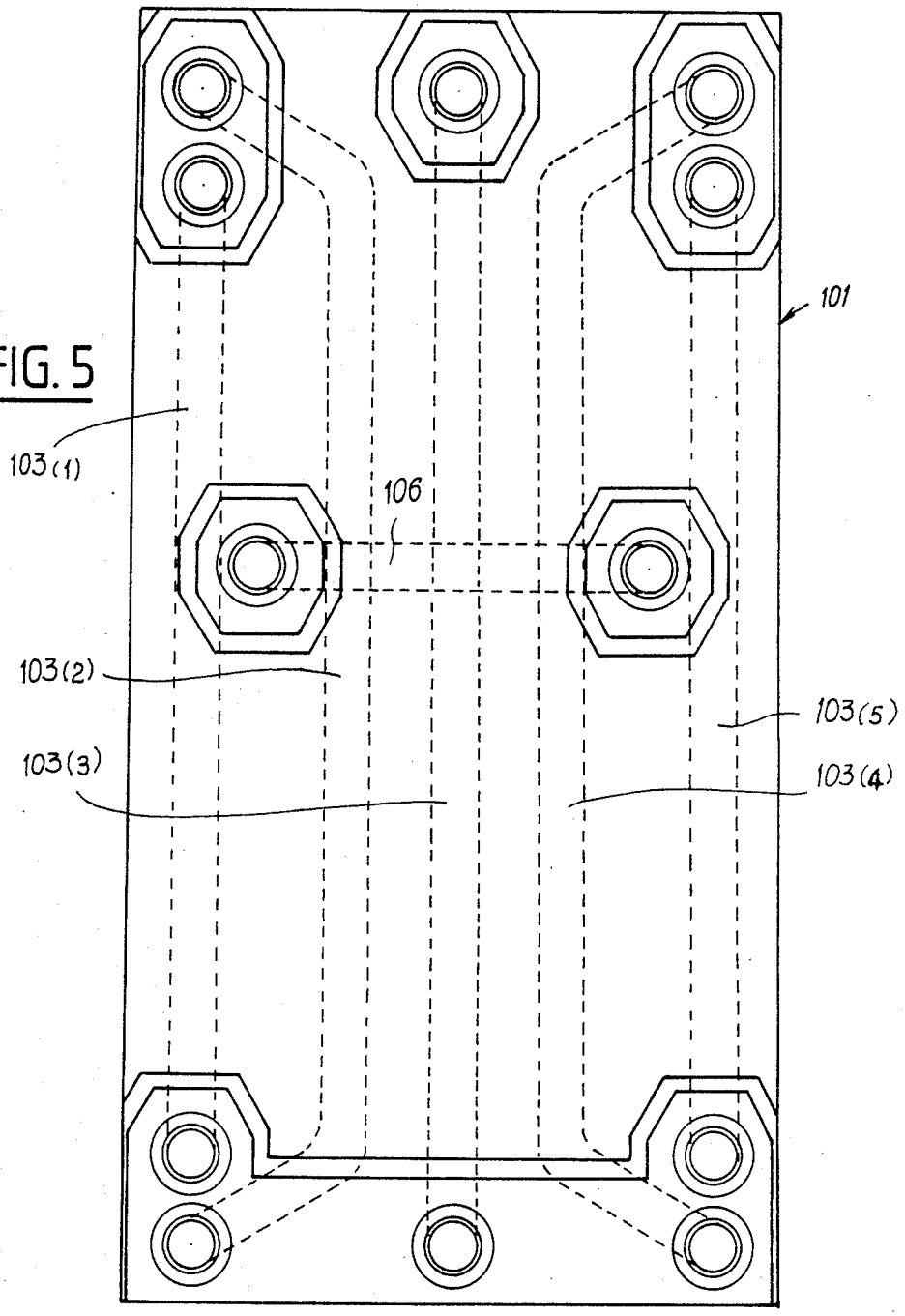
FIGS. 5 and 6 are respectively elevational views of the two sides of the plate shown in FIG. 4.
Figure 6:
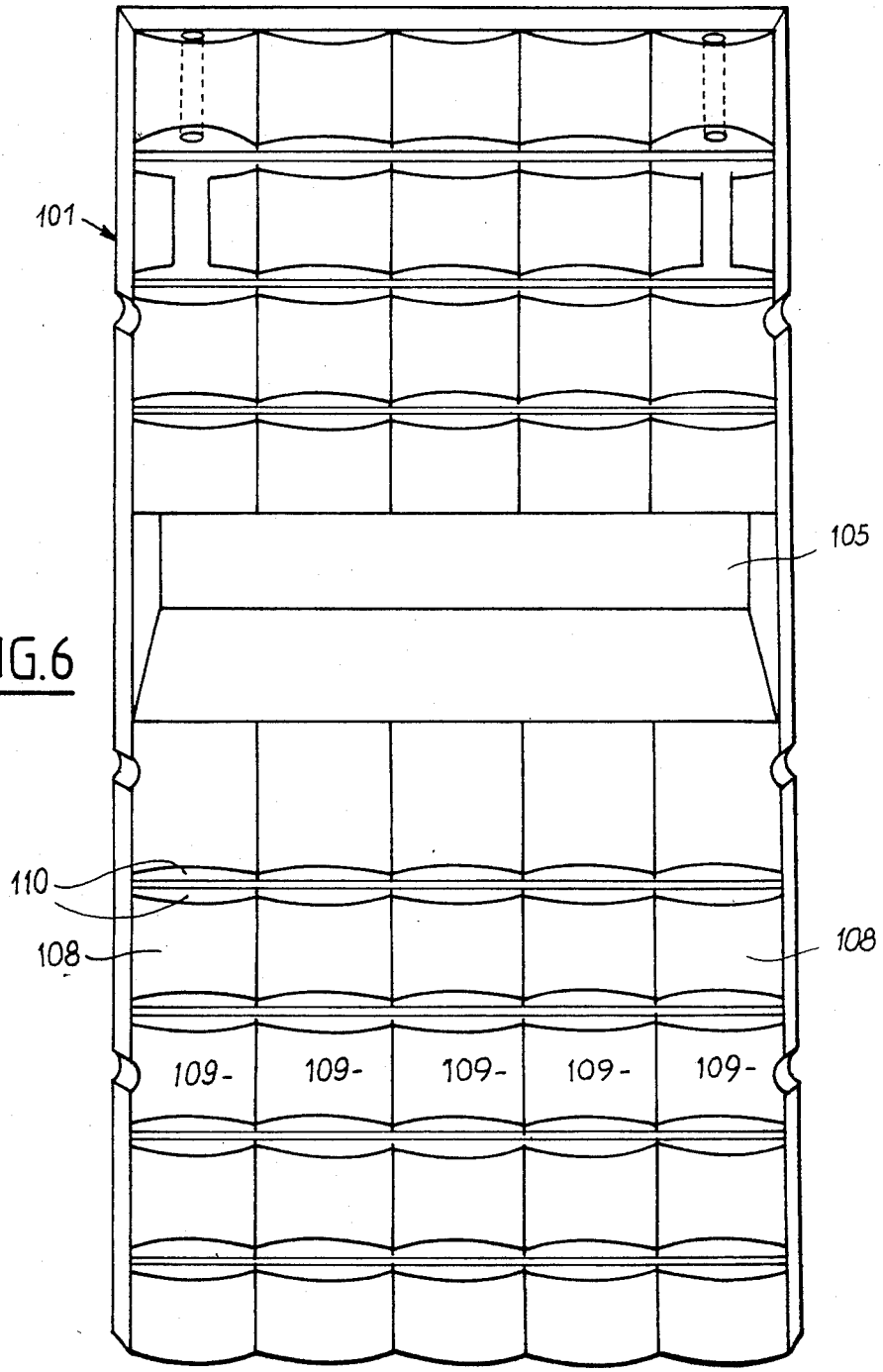

FIG. 3 clearly shows the V-section defined by the confronting transversely extending surfaces of two adjacent bosses. Also seen in FIG. 3 is the longitudinal path of the cooling tube 3 interconnecting the inlets 3*a* and outlets 3*b*. When this plate is in position in the blast-furnace, the tubes 3 are substantially vertical, while the transverse cooling tube 6 of the lip 5 is placed substantially horizontally. The distance between the axes of the tubes shown in FIG. 1 may be varied while making sure that the axis of the tube 3 coincides with the axis of the part-cylindrical portion constituting the surface 9. The tube 3 is thus surrounded by a constant thickness of iron equal to the radius R in which a temperature gradient can be established for achieving an equilibrium of the thermo-mechanical stresses produced by the thermal exchange between the heat flow issuing from the interior of the blast-furnace and the cooling tubes embedded within the cooling plate In the modification shown in FIGS. 4 to 6, the illustrated plate 101 has a lip 105 located in its central part in which a horizontally extending transverse tube 106 is disposed. It has on its side 102*a* facing the interior of the blast-furnace, five rows of bosses 108 defining, as before, portions of a cylinder 109 and separated by beveled parts 110. Five longitudinal cooling tubes 103(1), 103(2), 103(3), 103(4) and 103(5) correspond to these five rows of bosses. The inlet and the outlet of the central tube 103(3) are disposed in the vertical plane of symmetry of the plate. On the other hand, the inlets and outlets of the other tubes are grouped in the vicinity of the corners and in the vicinity of the longitudinal edges of the plate. This is achieved, for example, by bending the end portions of the tubes 103(2) and 103(4) so as to bring them respectively below and above the inlets and outlets of the end tubes 103(1) and 103(5).

This arrangement is particularly advantageous since it permits an increase in the cooling in the region of the corners of the plates which is usually particularly vulnerable.

What is claimed is:

1. In a cooling plate comprising a cast iron element having substantially the shape of a parallelpiped, embedded longitudinally extending tubes disposed vertically and parallel to one another and extending out of said element on a first side of said element, and a protective sleeve surrounding portions of said tubes extending out of said element; the improvement in combination therewith wherein a second side of said element opposed to said first side has a waffle shape, formed by rows of bosses evenly spaced apart transversely of said element, the bosses of a row defining projecting surfaces comprising substantially aligned portions of a cylinder, said cylinders having axes substantially coinciding with axes of said longitudinally extending tubes.

2. A plate according to claim 1, comprising beveled surfaces defining said bosses along transversely extending ends of said bosses, confronting beveled surfaces of two adjacent bosses defining a V-section groove extending transversely of said element.

3. A plate according to claim 1, wherein some of said tubes have inlets and outlets which are laterally offset relative to longitudinally extending parts of said some tubes.

4. A plate according to claim 2, wherein some of said tubes have inlets and outlets which are laterally offset relative to longitudinally extending parts of said some tubes.

5. A plate according to claim 3, wherein said inlets and said outlets of said some tubes are grouped together in a region located in the vicinity of each of the corners of said element.

6. A plate according to claim 4, wherein said inlets and said outlets of said some tubes are grouped together in a region located in the vicinity of each of the corners of said element.

* * * * *